US006291939B1

(12) United States Patent
Nishida

(10) Patent No.: US 6,291,939 B1
(45) Date of Patent: Sep. 18, 2001

(54) ION SOURCE DEVICE

(75) Inventor: Eiji Nishida, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/372,598

(22) Filed: Aug. 12, 1999

(30) Foreign Application Priority Data

Aug. 26, 1998 (JP) ..... 10-239723

(51) Int. Cl.[7] ..... H01J 7/24; H05B 31/26

(52) U.S. Cl. ..... 315/111.81; 315/111.21; 250/423 R; 118/723 IR; 118/723 AN

(58) Field of Search ..... 315/111.81, 111.21, 315/111.91; 219/121.48; 250/492.21, 492.3, 423 R, 426; 118/723 AN, 723 I, 723 IR

(56) References Cited

U.S. PATENT DOCUMENTS 4,971,832 * 11/1990 Arai et al. ..... 118/723 IR

FOREIGN PATENT DOCUMENTS 59-90779 5/1984 (JP) .
60-44953 3/1985 (JP) .

* cited by examiner

*Primary Examiner*—Michael B. Shingleton
(74) *Attorney, Agent, or Firm*—Burns, Doane, Swecker & Mathis, LLP

(57) ABSTRACT

An ion source device is capable of reducing deterioration of a source due to virulent gas, such as moisture or oxygen, which may adversely affect an ion source, while maintaining the ion source in an ion source driving installation state. An ion source device, which is installed for operation, is supplied with gas, such as inactive gas, which contains a reduced level of gas with possible adverse effect on the ion source, through an ion source driving gas supplying line form the outside of the device, such as a man-made satellite equipped with an ion source. Moreover, inactive gas remaining in a storage vessel provided in the course of the inactive gas supplying line, discharges on itself, thereby continuously purging the ion source.

7 Claims, 4 Drawing Sheets

ION SOURCE DEVICE

BACKGROUND OF THE INVENTION

1. Field of the Invention

The present invention relates to an ion source device, including an ion engine device and a plasma contact for controlling posture, orbit, and electrification of a man-made satellite, and an ion source generator for an atomic furnace.

2. Description of the Related Art

FIG. 6 is a diagram illustrating an exemplary method for preventing deterioration of an ion source according to related art. The diagram shows an ion source 1 (such as an ion engine device and a plasma contact), ion source purge gas 5 (such as a dry, inactive gas), an ion source sealing vessel 13, an open-type cathode 15, a discharge chamber 16, an opened grid 17, and an ion source device sealing vessel evacuate/gas-exchange device 24. The ion source purge gas 5 contains no, or a harmless level of, virulent gas 7, such as moisture or oxygen in air, which may adversely affect the performance of the ion source 1. The ion source sealing vessel 13 is either filled with the ion source purge gas 5 or else vacuumed to maintain the ion source 1 therein. The cathode 15, the chamber 16, and the opened grid 17 are formed in the inside of the ion source 1. The evacuate/gas-exchange device 24 evacuates the ion source sealing vessel 13 or exchanges the internal gas.

Next, one method used to prevent deterioration of an ion source will be described. In this method, the ion source sealing vessel 13 is initially evacuated using the evacuate/gas-exchange device 24, and is then filled with the ion source purge gas 5. This process is repeatedly carried out. Alternatively, a vacuum is maintained inside the ion source sealing vessel 13 by continuously evacuating the vessel 13 using the evacuate/gas-exchange device 24.

With the above, the virulent gas 7 is prevented from passing through the opened grid 17 and invading further inside to the discharge chamber 16 to deteriorate the inside of the chamber 16 and the open-type cathode 15 in the chamber 16 through contact.

As the opened grid 17, the discharge chamber 16, and the open-type cathode 15 are kept shut away from virulent gas 7 in the ion source 1, as described above, adverse effect due to the virulent gas 7 can be reduced. The adverse effect may include abnormal discharging due to degassing of the gas or moisture having been absorbed while preserving the ion source 1 in air, which may occur at the time of driving the ion source, and life reduction or deteriorated operation characteristics due to the gas or moisture having invaded, while preserving the ion source 1 in air, into the open-type cathode 15, and so on.

FIG. 7 is a diagram illustrating another example of a related method for preventing deterioration of an ion source. The drawing shows an ion source 1, an ion source purge gas supplying device 3, ion source purge gas 5, virulent gas 7 (such as, moisture, oxygen, and so on) which may adversely affect an ion source, a system body 9 (such as a man-made satellite) for incorporating the ion source device, an ion source non-sealing cover 14, an open-type cathode 15, a discharge chamber 16, an opened grid 17, gas discharged state 18 in which the ion source purge gas supplied from the supplying device 3 is discharged into air, a slit 19 formed at the edge of the ion source purge non-sealing cover 14, and a purge gas supplying line 20 through which the purge gas 5 is supplied from the supplying device 3 to the cover 14. The ion source purge gas 5 contains no, or a harmless level of, virulent gas 7. The ion source non-sealing cover 14 is attached to the ion source 1 which remains incorporated into the system body 9. The cathode 15, the chamber 16, and the opened grid 17 are formed in the inside of the ion source 1.

This method for preventing deterioration of the ion source will be described. In this method, the ion source 1 remains incorporated into the system body 9. The ion source purge gas 5 is continuously or discontinuously supplied from the ion source purge gas supplying device 3 via the purge gas supplying line 20 to the ion source purge non-sealing cover 14. The supplied gas 5 passes through the opened grid 17 inside the ion source 1 covered by the non-sealing cover 14, to invade the inside of the ion source 1, in particular, the open-type cathode 15, the discharge chamber 16, and the opened grid 17, and is finally discharged (18) through the slit 19.

With the above, the internal parts of the ion source 1 susceptible to deterioration due to the virulent gas, namely, the open-type cathode 15, the discharge chamber 16, and the opened grid 17, are exposed to the flowing ion source purge gas 5 so that contact of these parts with the virulent gas 7 can be reduced. With an arrangement in which the purge gas 5 is discharged (18) through the slit at the edge 19 of the cover 14, the pressure of the air under the cover 14 can be maintained at a slightly higher level than that outside of the cover 14 by gas flow created around the slit. Backflow of the virulent gas 7 via the slit at the edge 19 into the area under the cover 14 can therefore be prevented.

According to the above method, as the ion source 1 is preserved and remains installed to the body system 9, such that the incorporated open-type cathode 15, discharge chamber 16, and opened grid 17 are kept shut away from the virulent gas 7, adverse effects due to the virulent gas 7 can be reduced. The adverse effect may include abnormal discharging due to degassing of the gas or moisture having been absorbed while preserving the ion source 1 in air, which may occur at the time of driving the ion source, and life reduction or deteriorated operation characteristics due to the gas or moisture having invaded, while preserving the ion source 1 in air, into the open-type cathode 15, and so on.

An ion source 1 as shown in FIG. 6 must be preserved in an ion source sealing vessel 13. That is, the ion source 1 must be preserved under conditions different from those it will operate under, which are the conditions when the ion source 1 is actually installed in a man-made satellite for operation in orbit. Therefore, a process is required to activate the ion source 1 in a preserved state to be in an operation state. Because such a process is required, during which the ion source 1 in its entirity is thus exposed to air which may contain virulent gas 7, adverse effects to the ion source are possible. This may cause a problem such that the inside of the ion source 1, particularly, the discharge chamber 16 and the open-type cathode 15 in the chamber 16 may be brought into contact with air invading through the opened grid 17.

The ion source as shown in FIG. 7 includes an improvement enabling purging of the ion source 9 which remains installed to the system body 9, similar to as is described referring to FIG. 6, so that the discharge chamber 16 and the open-type cathode 15 can be prevented from exposure to air with virulent gas 7 through the opened grid 17 when the ion source 1 removed from the conditions of its preserved state to be set in an installation state in the system body 9.

However, in this purge vessel, where the purge gas flows to covering the entire ion source, the purge gas stagnates near the internal parts of the ion source 1, which are susceptible to the influence of the virulent gas 7, e.g., near the discharge chamber 16 and the open-type cathode 15. In other words, since the purge gas 5 does not pass through the susceptible parts, e.g., the cathode 15, the chamber 16, and the opened grid 17 to purge them, the influence due to the virulent gas 7 to these parts can not be prevented with any reliability.

Further, during the period from the removal of the ion source 1 from the sealing vessel 13, which includes exposure to air with virulent gas 7, to it's installation in the system body 9, thereafter providing the ion source purge gas supplying device 3, the purge gas supplying line 20, and the ion source purge non-sealing cover 14, and until the air is completely exchanged with the ion source purge gas 5 supplied from the supplying device 3, those parts susceptible to adverse influence of the virulent gas 7, e.g., the open-type cathode 15, the discharge chamber 16, and the opened grid 17, remain in contact with the virulent gas 7.

Still further, as any attachments, such as a purge vessel, attached to the ion source 1 must be removed before driving of the ion source device can be started, virulent gas may contact or invade into the ion source 1 after the attachments were removed. In addition, as the purge vessel is of non-sealing type, virulent gas may invade through the slit to contact the ion source while the purge gas supplying device suspends operation.

SUMMARY OF THE INVENTION

The present invention has been conceived to overcome the above problems and aims to reduce the adverse effects of the contact or invasion of a virulent gas while the ion source is kept in installation state on an ion source According to the present invention, there is provided an ion source device which can prevent virulent gas from contacting the interior parts of the ion source which is susceptible to adverse effect of the virulent gas. Specifically, an ion source purge gas supplying line is joined to the ion source driving gas supplying line so that the purge gas will flow through the susceptible part. Further, switching valves are provided for switching between supplying of the ion source driving gas and the ion source purge gas to the ion source.

Further, an ion source device according to the present invention is provided with a storage vessel formed in the inside of the ion source device in the path of the purge gas supplying line for storing ion source purge gas supplied from the outside of the ion source device so that the ion source can be continuously purged even after stoppage of supplying the ion source purge gas.

Still further, the whole of an ion source device according to the present invention is covered by a sealing cover. Due to the presence of the cover, the entire ion source can be kept in a sealed condition while being installed to a system body, and the space under the sealing cover cab be maintained in vacuum or can be filled with gas, such as a dried inactive gas, which excludes components, such as moisture or oxygen, with possible adverse effects on the ion source.

Yet further, the sealing cover installation part of the ion source device according to the present invention may preferably have a mechanism for displacing the sealing cover so that the sealing cover can remain attached to the ion source until the ion source is driven, and removed through remote controlling when the ion source is begun being driven. The mechanism comprises a spring, a screw, a gear, or the like.

Yet further, an ion source device according to the present invention may preferably comprise an ion source sealing cover detaching/re-attaching mechanism for enabling detaching and reattaching of the cover to retrieve sealed condition through remote controlling so that the sealing cover can remain installed irrespective of surrounding condition, such as external pressure, until the ion source is begun being driven.

BRIEF DESCRIPTION OF THE DRAWINGS

The above and other objects, features, and advantages of the present invention will become further apparent from the following description of the preferred embodiment taken in conjunction with the accompanying drawings wherein.

DESCRIPTION OF THE PREFERRED EMBODIMENTS

Embodiment 1

Figure 1:
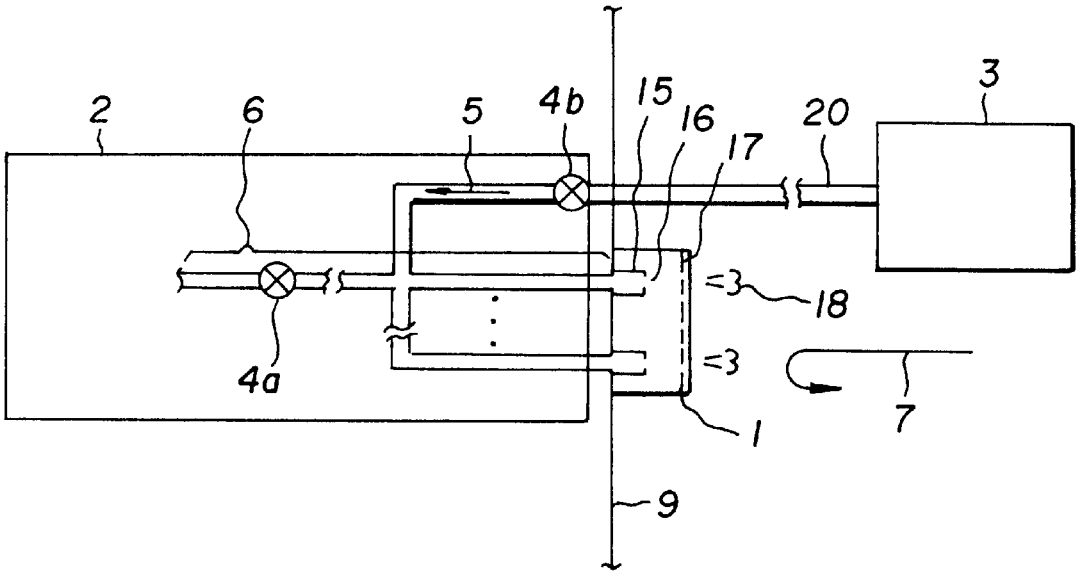
FIG. 1 is a diagram showing a structure of an ion source according to a first preferred embodiment of the present invention.

FIG. 1 is a diagram showing a structure of an ion source device and an ion source purge gas supplying device according to a first preferred embodiment of the present invention. The drawing shows an ion source 1, an ion source driving gas supplying device 2, an ion source purge gas supplying device 3, switching valves 4, an open-type cathode 15, a discharge chamber 16, an opened grid 17, a state 18 in which the gas supplied to the open-type cathode 15 and passed through the discharge chamber 16 and the opened grid 17 is discharged to the outside of the ion source 1, and a purge gas supplying line 20. The ion source purge gas supplying device 3 supplies ion source purge gas 5, which may be dried inactive gas, and contains no, or only a harmless level of, virulent gas 7, such as moisture or oxygen in air, which may adversely affect the performance of the ion source. The switching valves 4 switch gas supplying from between the ion source driving gas supplying line 6 associated with the ion source driving gas supplying device 2 and the ion source purge gas supplying device 3. The open-type cathode 15, incorporated into the ion source 1, is susceptible to adverse influence due to the virulent gas 7. The discharge chamber 16, also incorporated into the ion source 1, includes the open-type cathode 15. The opened grid 17, constituting a part of the discharge chamber 16, has an opening, through which the chamber 16 contacts the outside of the ion source 1. In the drawing, the switching valve 4*a* on the side of the ion source driving gas supplying device 2 is closed, while the switching valve 4*b* on the side of the ion source purge gas supplying device 3 is opened so that the ion source purge gas 5 is supplied from the ion source purge gas supplying device 3 to the ion source 1.

In operation, the switching valve 4*b* on the purge gas supplying device 3 side is opened while the switching valve

4*a* on the driving gas supplying device 2 side is closed for continuous supplying of the purge gas 5 from the purge gas supplying device 3. With this arrangement, the ion purge gas 5 can pass through the interior parts of the ion source 1, e.g., the open-type cathode 15, the discharge chamber 16, and the opened grid 17, which are susceptible to adverse effect of the virulent gas 7, to be finally discharged (18) while maintaining the ion source 1 in incorporated state into the system body 9. As a result, the susceptible parts in the inside of the ion source 1 can be directly exposed to the flow of the purge gas 5.

In the ion source 1 having the above structure, the purge gas is supplied through the ion source driving gas supplying line 6 to the ion source, which remains incorporated into the system body 9, such that the purge gas passes through the interior parts of the ion source 11 e.g., the open-type cathode 15, the discharge chamber 16, and the opened grip 17, which are susceptible to the virulent gas 7. With the above, the adverse effect due to the virulent gas 7 can be removed without provision of a cover, or the like, to the ion source 1.

Accordingly, contact of the virulent gas 7 with the susceptible parts in the inside of the ion source is more quickly eliminated after the supply of the purge gas is begun, and possibility for the virulent gas 7 to contact such parts can be more consistently prevented, as compared to the conventional supplying of the purge gas in which the purge gas commonly stagnates around the open-type cathode 15, the discharge chamber 16, the opened grip 17, and such parts.

A purge gas supplying device 3 having the above structure is connected to the ion source device via the purge gas supplying line 20 only. This more readily facilitates detaching and attaching of the supplying device 3 with respect to the ion source device than the above-described conventional designs in which the ion source purge non-sealing purge cover covers substantially the whole of the ion source 1. Therefore, the purge gas supplying device 3 of the present invention suffers from less limitation, such as physical interference with peripheral devices of the ion source 1 held installed to the system body. This advantageously reduces chances of discontinued purging and the need of detaching a purge gas supplying device at an earlier stage, reducing a period of discontinued purging.

With an ion source device having an alternative arrangement which incorporates the purge gas supplying device 3, the purge gas supplying line 20, and the switching valves 4*a*, 4*b*, and is adapted to remote control for opening/closing the switching valves 4*a*, 4*b*, starting and halting of the ion source 1 purging can be controlled through remote control of the switching valves 4*a*, 4*b*. As a result, it is possible to control the device so that, after the ion source device is installed in a vacuum vessel and the vessel is vacuumed, purging is continuously applied to the ion source 1 until no realistic possibility remains that the virulent gas 7 will damage the any portion of the ion source 1, or purging can be resumed before the ion source 1 is removed from the vacuum vessel.

Embodiment 2

Figure 2:
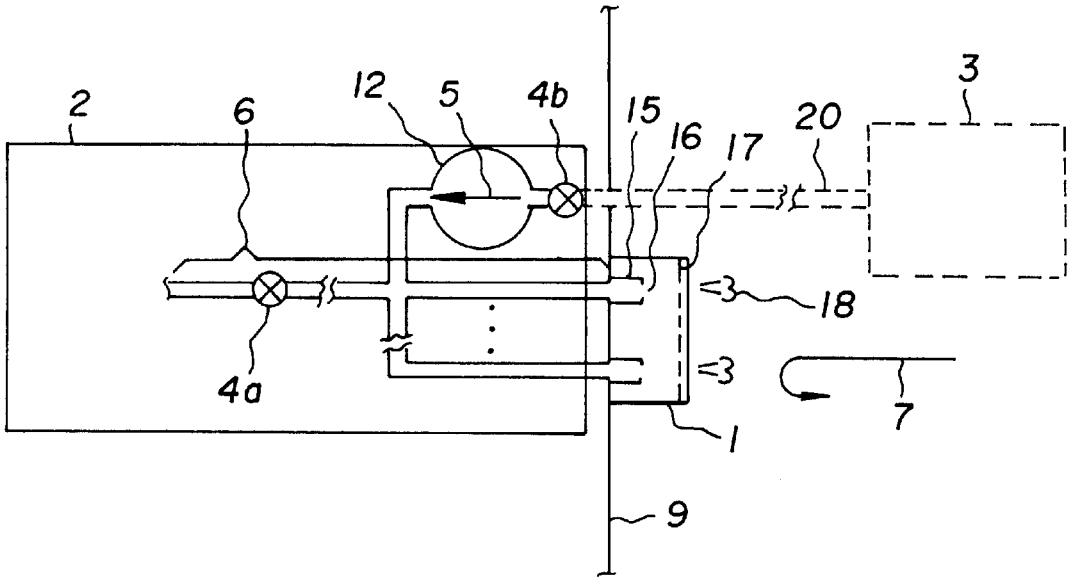
FIG. 2 is a diagram showing a structure of an ion source according to a second preferred embodiment of the present invention.

FIG. 2 is a diagram showing a structure of an ion source device according to a second preferred embodiment of the present invention. The drawing shows a storage vessel 12 provided between two switching valves 4. In the drawing, the switching valve 4*a* on the side of the ion source driving gas supplying device 2 is closed, while the switching valve 4*b* on the side of the ion source purge gas supplying device 3 is opened so that the ion source purge gas 5 is supplied from the ion source purge gas supplying device 3 to the ion source 1.

In operation, before the launch of a man-made satellite equipped with an ion source 1, the ion source 1 is purged using the gas from the ion source purge gas supplying device 3 to be kept shut off from the virulent gas 7 which may adversely affect the ion source 1. Immediately before the launch, the purge gas supplying device 3 is removed. Even though the device 3 is removed, the ion source 1 can be continuously purged using the purge gas remaining in the storage vessel 12 during a period determined using the following expression based on the pressure and temperature of the residual purge gas, the capacity of the storage vessel 12, and the pressure, temperature, and a flowing amount of the gas discharging from the ion source 1.

$$\frac{P_0V_0}{T_0} = \int^{\Delta t} \frac{P_1 v}{T_1}\, dt \tag{1}$$

wherein $P_0$, $T_0$, $V_0$ represent the pressure and temperature of the purge gas remaining in the storage vessel 12, and the capacity of the vessel 12, respectively; $P_1$, $T_1$, v represent the pressure, temperature, and flowing amount of the gas discharging from the ion source 1, respectively; and $\Delta_t$ represents a time for possible purging using the residual gas in the vessel 12.

When $P_1$, v, and $T_1$ can be considered consistent, the following expression is obtained.

$$\frac{P_0V_0}{T_0} = \frac{P_1 v}{T_1}\Delta t \quad \therefore \Delta t = \frac{P_0V_0}{T_0}\frac{T_1}{P_1 v} \tag{2}$$

That is, the ion source 1 can be continuously purged during a period determined using the expression (2), using the purge gas supplied from the vessel 12 during a period $\Delta_t$.

Since the purge gas supplying device having the above structure can continue purging even after the ion source purge gas supplying device 3 is removed, as described above, when the purge gas supplying device 3, and so on, is not incorporated into the ion source device, and the purge gas supplying device 3 must be removed, such as, immediately before the launch of a man-made satellite equipped with the ion engine device, the ion source 1 can be thereafter continuously purged. When the satellite reaches its orbit where the ion source 1 will be placed in a vacuum and purging will no longer be necessary, the residual purge gas will passively exhaust itself without requiring any outside operation.

Embodiment 3

Figure 3:
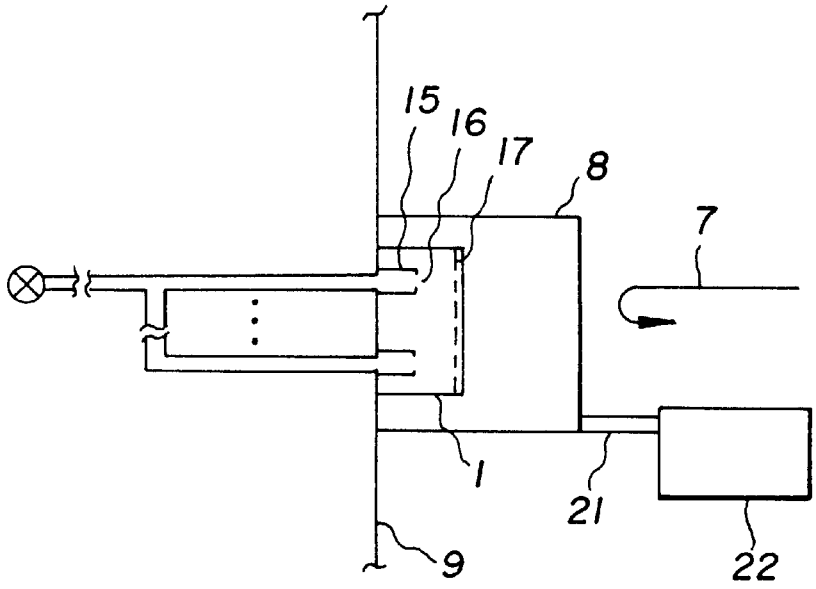
FIG. 3 is a diagram showing a structure of an ion source according to a third preferred embodiment of the present invention.

FIG. 3 is a diagram showing a structure of an ion source device according to a third preferred embodiment of the present invention. The drawing shows an ion source sealing cover 8, an evacuate/gas-exchange line 21 for space under the ion source sealing cover, and a vacuum evacuate/gas-exchange device 22 for space under the ion source sealing cover 22. The sealing cover 8 covers and seals an ion source device and installation parts remaining in an ion source driving installation state (9) to keep the ion source 1 in sealed condition. The vacuum evacuate/gas-exchange line 21 is a line through which the space under the cover 8 is evacuated or gas-therein is exchanged. The vacuum evacuate/gas-exchange device is a device for carrying out vacuum evacuate/gas-exchange for the space under the cover 8 through the line 21.

During operation, the ion source 1 is covered by the ion source sealing cover 8 while remaining installed to a system body 9. The ion source 1 in such a state is sealed-connected so that the inside thereof can be shut off from the outside of the cover 8. Through the vacuum evacuate/gas-exchange line 21, the vacuum evacuate/gas-exchange device 22 evacuates the space under the sealing cover 8 to make it vacuum. Alternatively, after the space is evacuated and a vacuum is formed, the created vacuum space is fulfilled with purge gas 5 which contains a harmless level of virulent gas 7 with possible adverse effect on the ion source 1. The above process will be repeatedly carried out. With the above arrangement, it is possible to prevent the ion source 1, which remains installed to the system body 9, from contacting the virulent gas 7 which may adversely affect the ion source 1.

An ion source having the above structure can remain installed on a system body 9 yet avoid being adversely affected by the virulent gas 7.

Embodiment 4

Figure 4:
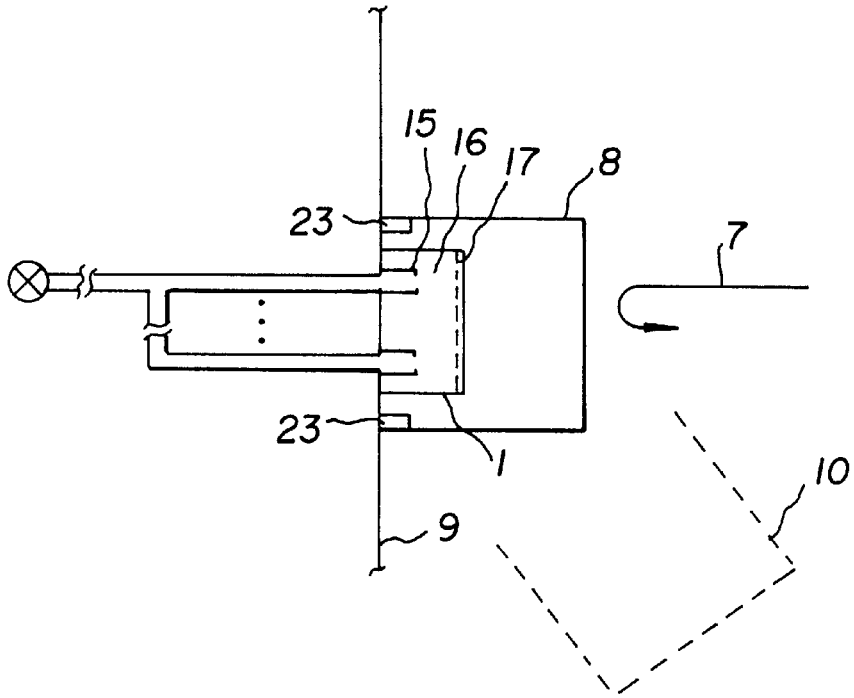
FIG. 4 is a diagram showing a structure of an ion source according to a fourth preferred embodiment of the present invention.

FIG. 4 is a diagram showing a structure of an ion source device according to a fourth preferred embodiment of the present invention. The drawing shows an ion source sealing cover 8, displaced state 10 of the cover 8 from the installation part of the ion source 1 when the ion source is yet to be driven, and an ion source sealing cover holding/releasing mechanism 23. The sealing cover 8 covers and seals an ion source device and installation parts which remain installed on a system body 9 to keep the ion source 1 in sealed condition. The ion source sealing cover holding/releasing mechanism 23 is incorporated into the installation part of the cover 8.

In operation, when the ion source 1 is yet to be driven and remains in circumstance where virulent gas 7 with possible adverse effect on the ion source is present in the outside of the sealing cover 8, the ion source 1 is preserved being installed to the system body 9 and covered by the sealing cover 8 to be shut off from the virulent gas 7, similar to the case in the third preferred embodiment. When the ion source 1 is placed in condition where only a harmless level of virulent gas 7 is present in the outside of the ion source sealing cover 8, such as when the satellite with the ion source 1 reaches orbit in vacuum atmosphere, a stopper incorporated into the ion source sealing cover holding/releasing mechanism 23 is released through remote controlling. As a result, trapped gas in the space under the cover 8, begins discharging into the surrounding vacuum in orbit, and the sealing cover 8 is displaced as a reaction to the discharging force.

When an ion source having the above structure is remains in circumstances where virulent gas 7 with possible adverse effect on an ion source is present outside the sealing cover 8, the ion source is preserved in an ion source driving installation state and covered by the ion source sealing cover 8 so as to be protected from the virulent gas 7, in a manner similar to that of the third embodiment. When the ion source 1 is placed in conditions where only a harmless level of virulent gas 7 is present in the outside of the ion source sealing cover 8, such as when the satellite with the ion source 1 reaches orbit, the ion source sealing cover 8, provided to the ion source, can be removed through remote controlling. With the above configuration, the ion source 1 can be protected from contact with virulent gas when it is yet to be driven, and the cover 8 can be removed by remote control when the ion source 1 is to operate.

Embodiment 5

Figure 5:
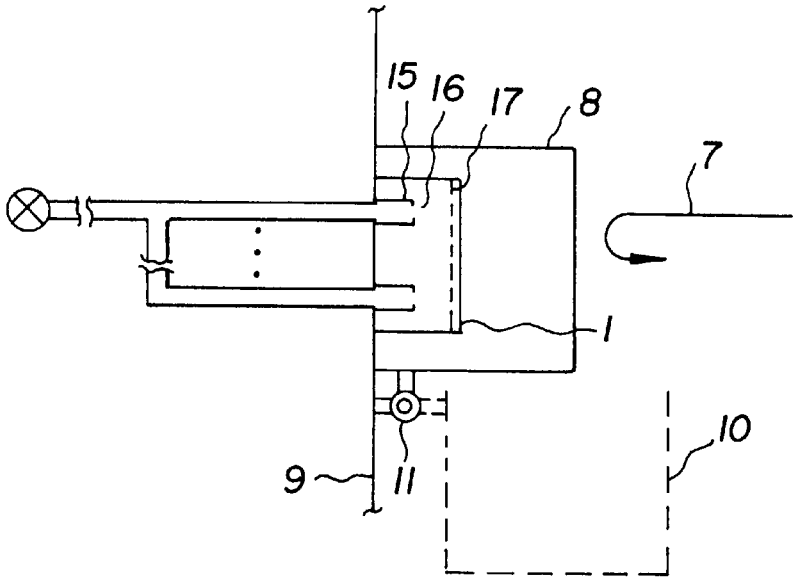
FIG. 5 is a diagram showing a structure of an ion source according to a fifth preferred embodiment of the present invention.
Figure 6:
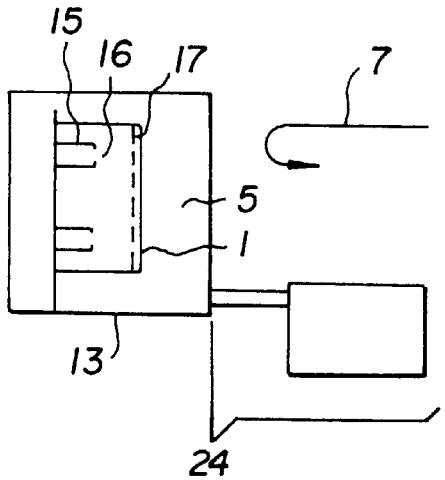
PRIOR ART Fig. 6
FIG. 6 is a diagram showing an example of an ion source according to the related art.
Figure 7:
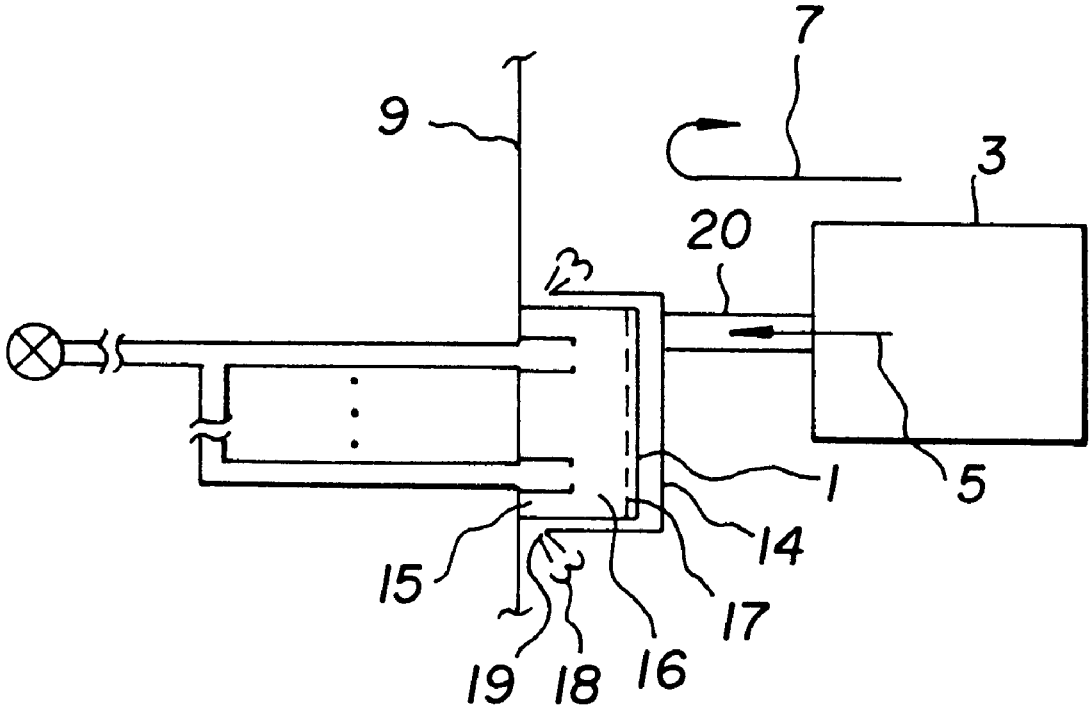
PRIOR ART Fig. 7
FIG. 7 is a diagram showing another example of an ion source according to the related art.

FIG. 5 is a diagram showing a structure of an ion source according to a fifth preferred embodiment of the present invention. The drawing shows an ion source sealing cover 8, and an ion source sealing cover detaching/reattaching mechanism 11. The sealing cover 8 covers and seals an ion source device and installation parts which remain installed to a system body 9 to maintain the ion source 1 under a sealed condition. The ion source sealing cover detaching/reattaching mechanism comprises a motor, a gear, and on the like, and enables detaching and reattaching the cover 8 through remote control.

In operation, similar to the fourth embodiment, when the ion source 1 is yet to be driven and remains in circumstance where virulent gas 7 with possible adverse effect on an ion source is present outside of the sealing cover 8, the ion source 1 is preserved in an ion source driving installation state and covered by the sealing cover 8 to be shut off from the virulent gas 7. When the ion source 1 reaches the vacuum environment in earth orbit, or is evacuated in a laboratory to be thereby placed in condition with reduced virulent gas 7 present in the outside of the sealing cover 8, the sealing cover 8 can be removed. Moreover, when the experiment completes and the ion source 1 is re-exposed to air, or any circumstance where virulent vas 7 is present, the cover 8 can be reattached using the detaching/reattaching mechanism 11.

With an ion source having the above structure, the ion source sealing cover 8 thereof can be detached so that the ion source is ready for operation, in circumstance where no virulent gas 7 with possible adverse effect on the ion source is present around the ion source, e.g., when the ion source is used in an experiment on the ground of an ion source for a man-made satellite, and can also be reattached when the ion source is possibly brought into contact with the virulent gas, e.g., when the ion source is removed from a protective container and exposed to air, so that the ion source 1 can be prevented from contacting the virulent gas 7, even in air.

What is claimed is:

1. An ion source device, comprising:

an ion source having interior parts including a discharge chamber incorporating an open-type cathode with an exposed discharge, and a grid having an opening;

a gas supplying device having a first gas supplying path for supplying ion source driving gas and a second gas supplying path for supplying purge gas directly to said interior parts of said ion source; and a valve for switching between the first gas supplying path and the second gas supplying path.

2. An ion source device according to claim 1, further comprising a storage vessel provided in a course of the second gas supplying path.

3. An ion source device, comprising:

an ion source having a discharge chamber incorporating an open-type cathode with an exposed discharge portion, and a grid having an opening;

a gas supplying device for supplying ion source driving gas; and a sealing cover for solely covering said ion source in a system incorporating said ion source.

4. An ion source device according to claim 3, further comprising a mechanism formed at an installation part of said sealing cover, for removing said sealing cover through remote control.

5. An ion source device according to claim 4, further comprising a mechanism for reattaching said sealing cover through remote control.

6. An ion source device according to claim 3, further comprising a device for evacuating space under said sealing cover.

7. An ion source device according to claim 3, further comprising a device for evacuating and supplying space under said sealed cover with the purge gas for said ion source.

US 6,2291,939 B1
9 10

* * * * *